United States Patent [19]

Mecke et al.

[11] Patent Number: 4,898,486

[45] **Date of Patent: * Feb. 6, 1990**

[54] THERMAL TRANSFER RIBBON, ESPECIALLY FOR IMPRESSIONS ON ROUGH PAPER

[75] Inventors: Norbert Mecke, Hannover; Heinrich Krauter, Neustadt, both of Fed. Rep. of Germany

[73] Assignee: Pelikan Aktiengesellschaft, Hannover, Fed. Rep. of Germany

[ * ] Notice: The portion of the term of this patent subsequent to Jan. 23, 2007 has been disclaimed.

[21] Appl. No.: 154,651

[22] Filed: Feb. 10, 1988

Related U.S. Application Data

[63] Continuation-in-part of Ser. No. 109,489, Oct. 15, 1987.

[30] Foreign Application Priority Data

Oct. 15, 1986 [DE] Fed. Rep. of Germany ..... 3635141

[51] Int. Cl.[4] ..... B41J 31/00

[52] U.S. Cl. ..... 400/241.2; 400/120; 428/195; 428/321.3

[58] Field of Search ..... 400/120, 241.1, 241.2; 428/195, 321.3, 914, 915, 913

[56] References Cited

U.S. PATENT DOCUMENTS

| | | | |
|---|---|---|---|
| 2,739,909 | 3/1956 | Rosenthal | 400/241.2 X |
| 4,515,489 | 5/1985 | Kohle et al. | 400/241.2 |
| 4,612,243 | 9/1986 | Shimayahi et al. | 428/321.3 |
| 4,707,707 | 11/1987 | Ohno | 400/120 X |
| 4,774,128 | 9/1986 | Koshizuka et al. | 428/195 X |
| 4,783,360 | 11/1988 | Katayama et al. | 428/195 X |
| 4,784,905 | 11/1988 | Suzuki et al. | 428/195 X |

FOREIGN PATENT DOCUMENTS

| | | | |
|---|---|---|---|
| 702556 | 1/1965 | Canada | 400/241.2 |
| 2847071 | 6/1979 | European Pat. Off. . | |
| 163297 | 4/1985 | European Pat. Off. . | |
| 1212497 | 9/1966 | Fed. Rep. of Germany . | |
| 1201855 | 3/1970 | Fed. Rep. of Germany . | |
| 2030604 | 1/1971 | Fed. Rep. of Germany . | |
| 3328990 | 2/1985 | Fed. Rep. of Germany . | |
| 3635141 | 3/1988 | Fed. Rep. of Germany . | |
| 166088 | 12/1981 | Japan | 400/241.2 |
| 108183 | 6/1983 | Japan | 400/241.2 |
| 78777 | 5/1985 | Japan | 400/241.2 |
| 2094383 | 4/1987 | Japan | 400/241.2 |

*Primary Examiner*—William Pieprz
*Assistant Examiner*—James R. McDaniel
*Attorney, Agent, or Firm*—Herbert Dubno

[57] ABSTRACT

A thermocarbon ribbon is formed by emulsifying two mutually incompatible thermoplastic polymers melting at heat-transfer temperatures of a wax. The emulsion containing a pigment is applied to a ribbon support and the solvent is evaporated. The ribbon has multi-strike capabilities and improved sharpness of transfer to rough paper resulting from the presence in the solid continuous phase of beads or microspheres of a dispersed phase, both phases being formed by the polymers.

10 Claims, 1 Drawing Sheet

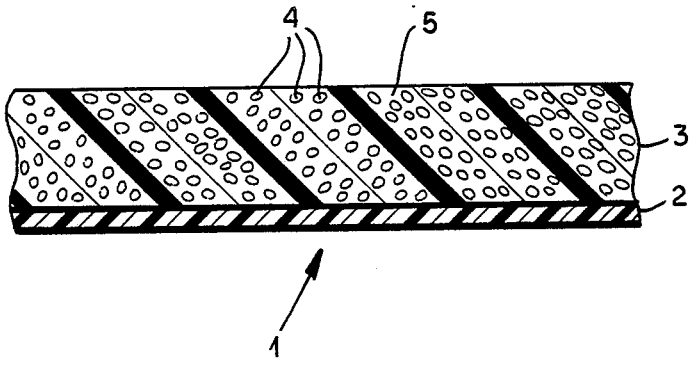
4
5
3
2
1

THERMAL TRANSFER RIBBON, ESPECIALLY FOR IMPRESSIONS ON ROUGH PAPER

CROSS REFERENCE TO RELATED APPLICATION

This application is a continuation in part of Ser. No. 07/109,489 filed 15 October 1987.

FIELD OF THE INVENTION

Our present invention relates to a thermal transfer ribbon, also referred to as a thermal carbon ribbon in the art, for the thermal transfer of alphanumeric and other characters to a copy sheet, e.g. of paper, by partial melting of a color-transfer layer on a substrate or support. The invention also relates to a method of making such a ribbon.

BACKGROUND OF THE INVENTION

It is known that various polymeric materials, upon being dissolved in a solvent, can be mutually incompatible. This incompatibility can have a variety of effects. For example, one polymer can flocculate out.

Alternatively, in certain systems, there is the possibility that both polymers will remain in solution but that there will be a liquid/liquid phase separation with mutually incompatible polymeric materials distributing themselves in different concentrations in the two phases.

Basic principles of such liquid/liquid phase separations and the relationship of the mutual incompatibility of the two polymers can be found in Dobry and Boyer-Kawenoki, *Journal of Polymer Science,* Vol. 2, No. 1, Pages 90–100, 1947.

Since the generation of such a system requires that the characteristics of three materials, namely, the two polymeric materials and the solvent, be taken into account, there has been no generalized technological use of such systems.

It is, however, possible, utilizing simple laboratory techniques, to determine suitable partners for the development of a liquid/liquid phase separation system. This will be evident from German patent document DE-OS No. 20 30 604 which describes a process for the formation of small polymer capsules.

According to the process of German patent document DE-OS No. 20 30 604, a liquid system of at least a first and a second hydrophobic polymer is formed in an organic solvent. The polymeric materials are so selected that they form, below a certain critical temperature, a homogeneous single-phase solution in the solvent. Above the critical temperature, a liquid/liquid phase separation occurs. In this case, particles of the core-forming material are dispersed in the liquid system. The system is agitated while its temperature is above the critical temperature to effect a wetting and coating of the dispersed particles of the core-forming substance by the separating phase to provide a liquid wall on each core particle. The capsules are thus grown in the liquid.

preferably the first polymer is a halogenated rubber and the second polymer a polyethylene-vinylacetate copolymer. The organic solvent is advantageously cyclohexane, toluene, xylene, carbon tetrachloride or methylisopropylketone. A similar process is described in German Pat. No. 1,212,497. From these disclosures, therefore, it will be evident that it is known to use such liquid/liquid phase-separated systems to produce microcapsules.

The Japanese patent publication JP No. 60-78 777A describes a thermocarbon ribbon which has an intermediate layer of its meltable transfer layer containing thermally expandable minute spheres or balls upon which the color layer is applied. This material has been found to have good printing and transfer quality even for rough papers.

However, this material is not suitable for multi-use (multi-strike) purposes and, because it is necessary to provide a separate layer containing the microscopic balls, the cost of fabricating the material is high.

German Pat. No. 12 01 855 describes a carbon ribbon which has small droplets or microscopic balls and non-volatile materials, a pigment or a dyestuff, distributed in a resin. This ribbon also is not suitable for multi-use or multi-strike purposes in a thermal transfer system.

OBJECTS OF THE INVENTION

It is the principal object of the present invention to provide a thermocarbon ribbon with a synthetic resin bonded melt-transfer color on a carrier which can be fabricated in a simple and economical manner, has especially good resolution and print quality on rough papers and has multi-use or multi-strike capabilities.

Another object of this invention is to provide an improved method of making such a thermocarbon ribbon.

SUMMARY OF THE INVENTION

These objects are attained, in accordance with the invention by providing a melt-transfer color layer for a thermal printing process utilizing a conventional thermal printing head, e.g. of the dot-matrix type, which contains meltable solid polymer spheres or balls, in a dispersed phase generally referred to as beads, in a continuous solid phase consisting essentially of at least one other polymer, a wax and/or a wax-like substance which is also meltable during the thermal printing process.

The method of the invention is carried out by providing in solution in a solvent the two different, mutually incompatible thermoplastic polymers which melt during the thermoprinting process to form a two-phase liquid/liquid phase separation system in the solution. The liquid/liquid phase separated system is then agitated while a coloring agent and a wax are supplied. The resulting color emulsion is applied to a carrier or support for a thermal carbon ribbon and the solvent of the emulsion is evaporated to form the solid color-transfer layer.

The term "coloring agent" is here used to refer to a pigment (e.g. carbon or like generally insoluble coloring matter) or to a dyestuff (i.e. coloring matter which is at least partially soluble in one or another of the solvents or liquid vehicles of the phases) or combinations of a pigment or a plurality of pigments with a dyestuff or plurality of dyestuffs.

In this connection it should be noted that the pigment or pigment component will generally be found in the continuous phase of the color-transfer layer or in increased concentration at the interface between the continuous phase and the dispersed phase. The dyestuff or dyestuff component will be found either in the beads of the dispersed phase or in the continuous phase or in both depending upon the solubility of the dyestuff component in the solvent or liquid vehicle of the respective phases.

When a "wax" or a "waxlike" material is referred to in accordance with the invention, it will be understood that this material should be, at a temperature of 20° C., not kneadable or plastically deformable, solid to brittlely hard, large crystalline to fine crystalline and transparent to opaque, but not glassy. Above 40° C., the material should melt without decomposing and should have a low viscosity at a temperature close to but above its melting point, while being non-ropey, i.e. capable of melting in a manner which does not form strings, strands or other ropey structure.

Waxlike materials within the invention include those which fall into the category above but can have physical and chemical characteristics largely similar to those of waxes.

The wax materials which can be used according to the invention include, without limitation, paraffins, silicones, natural waxes such as carnauba wax, beeswax, ozocerite and paraffin wax, synthetic waxes such as acid waxes, ester waxes, partly saponified ester waxes, polyethylene waxes, as well as polyglycols. In practical terms, the ester waxes have been found to be most suitable and especially the waxes commercially marketed as Hoechstwachs E and E-wax marketed by BASF and derived from montan wax.

The solvent which can be used to make the color emulsion of the invention can be any solvent in which the two mutually incompatible and mutually nonmiscible thermoplastic polymers are soluble and which also can dissolve the wax or the waxlike material.

Especially aromatic and chlorinated solvents such as toluene, xylene, tetrahydronaphthalene, chlorinated hydrocarbons such as trichloroethane, trichlorethylene, carbon tetrachloride, perchlorethylene and mixtures thereof have been found to be useful. Other nonaromatic solvents such as ethanol, ethylacetate and methylethylketone can be mixed with the solvents previously mentioned, especially the aromatic solvents.

Other solvents may, of course, be used as long as they have equivalent properties, but in general the limitations on the solvents will be those posed by excessively high boiling points or toxicity. For these latter reasons we have found toluene to be best.

It is not the purpose of this application to generalize as to the chemical and physical parameters required for the mutual incompatability and nonmiscibility of the two thermoplastic polymers, especially in the presence of a wax component, in the solution. As has already been stated, the ordinary worker in the art using simple tests can vary readily determine mutually incompatible polymer pairs. By way of guidance, we note that the mutually incompatible polymers may be selected one from one group of Groups I and II, while the other is selected from the other group. Group I consists of polystyrene (for example the commercial product polystyrene 143E of BASF AG), polyacrylates, polymethacrolates, polyamides, acrylonitrile-styrene copolymers, vinylidene- chloride-acrylonitrile copolymers, ethoxy resins and polyvinylformal. The polymers of Group II are ethylene-vinylacetate copolymer, polyvinylether, polyvinylester and polybutadiene.

The coloring agent can be any coloring agent which is commonly used in the melt-transfer color of thermocarbon ribbons. These agents, as noted, include dyestuffs as well as solid pigments. The pigments can be carbon black or phthalocyanine. Dyestuffs include especially the azo dyes. True pigments are generally defined as coloring agents which are not soluble even in the binder while the dyestuff is soluble in the solvent and/or the binder (see *Rompps Chemie-Lexikon*, 8. Aufl. D 1.2, 1981, S. 1239).

The coloring agent, whether dissolved or suspended, serves merely to provide a colored emulsion and in general can be present in both the beads and the continuous phase in which the beads are dispersed. The simultaneous presence of suspended and dissolved coloring agent can be ensured when a dyestuff is used in a supersaturated solution as or part of the coloring agent. The manner in which the coloring agent distributes itself in the beads and in the continuous phase will depend upon the type of coloring agent as noted previously.

It has been found to be advantageous in forming the emulsion to supply additives to the system which promote emulsification, or otherwise improve the properties of the thermocarbon ribbon. We have found that especially emulsifiers and/or softeners for the polymers (i.e. the polymer from Group I and the complementary polymer of Group II are desirable additives).

The softeners or plasticizers which are used can preferably be fatty acids, fatty acid esters and esters of phthalic acid and phthalic acid such as dioctylphthalate and tricresylphosphate. The emulsifiers which have been found to be most effective are wax emulsifiers such as the waxy emulsifier OSN (BASF), Emulan AF (BASF) and other Emulans.

The proportions of the substances forming the color-transfer layer can range widely and there are no critical limits, especially for the solvent proportion.

Too great excess of the solvent should be avoided because the evaporation of the solvent will then utilize too much energy.

As a rule the emulsion should contain from 5 to 30 parts by weight of the polymer of Group I, from 5 to 30 by weight of the parts polymer of Group II, from 10 to 40 parts by weight of the wax or the waxlike material and at least 60 parts by weight of the solvent, but in any event sufficient solvent to form the liquid/liquid phase-separation system.

When the polymer from Group I is polystyrene, polyacrylate or polyamide and the polymer from Group II is an ethylene-vinyl acetate copolymer, polyvinyl ether and/or polyvinyl ester, preferably 10 to 20 parts by weight of the polymer of Group I is used with 20 to 30 parts by weight of the polymer of Group II and 30 to 40 parts by weight of a wax, especially an ester wax. The solvent should be present in an amount of up to 400 parts by weight and in an amount of at least 9 parts by weight. Best results are obtained with 15 parts by weight of the polymer from Group I, 25 parts by weight of the polymer from Group II, 35 parts by weight of wax and at least 20 parts by weight and preferably 300 parts by weight of a solvent.

The amount of the coloring agent which is used will, of course, vary depending upon the desired intensity of the print to be transferred by the thermocolor layer. For satisfactory color intensities of the transferred image, the coloring agent should be present in an amount of from 5 to 30% by weight of the solidified melt-transfer color layer although the amount actually used can also deviate therefrom to the degree to which one desires a multi-use or multi-strike capability. The more uses or strikes that the ribbon must sustain, the greater will be the amount of the coloring agent to be supplied. Of course the color intensity will also depend upon the composition of the coloring agent which has been selected.

With respect to the amount of the solvent used, we note that in all cases it is important that the minimum amount of solvent be sufficient to dissolve both the polymer from Group I and the complementary polymer from Group II as well as the wax. From this minimum amount, one can deviate significantly to obtain the ideal coating characteristics of the emulsion on the foil forming the substrate.

Excess solvent, of course, results in an increase in the evaporation energy which must be supplied.

As a rule, the optimum solvent quantity will be two to three times the amount of the multiple solid substances which are to remain after the solvent has been evaporated. The other additives mentioned play a supporting role in this respect since they are usually present in an amount of 1 to 5by % weight of the solid melt-transfer layer.

The emulsion can be applied in a simple way to the carrier. Preferably it is applied by a doctor blade, a so-called "coater" and like apparatus commonly used for applying the color-transfer layer to a support strip of the ribbon.

The evaporation of the solvent from the emulsion is effected preferably by passing over it heated air at a temperature of about 60° to 80° C. Preferably the entire process is carried out in a continuous manner.

The carrier or support can be any ribbon support which has been found to be useful in thermocarbon ribbons up to now. Where multi-use or multi-strike properties are desired, the ribbon is a synthetic resin foil and polyester or polycarbonate which has a thickness between 4 and 10 micrometers.

The thermocarbon ribbon of the invention has been found to have numerous advantages. Firstly, it has multi-strike capabilities allowing the same region of the ribbon to be typed over from 5 to 30 times. By contrast with conventional thermocarbon ribbons, the ribbon of the invention has especially good rendition and resolution in printing on rough paper. A sharply delineated print can be obtained to a paper roughness of 20 Bekksecs. Apparently the dispersed polymer microballs or beads, with other times of 5 to 100 micrometers, improve the partial and metered transfer of the color layer and thus contribute to the multi-use effect. Of course the process can be carried out quite simply. The components are readily transformed into a coating emulsion by the use of a simple mixer.

BRIEF DESCRIPTION OF THE DRAWING

The above and other objects, features and advantages of the present invention will become more readily apparent from the following description, reference being made to the accompanying drawing, the sole FIGURE of which is a cross sectional view diagrammatically illustrating a thermal transfer ribbon of the invention.

SPECIFIC DESCRIPTION

In the drawing, the thermal transfer ribbon 1 is shown to comprise a carrier 2 upon which a color-transfer layer 3 is provided which contains the polymer balls or beads 4 dispersed in a continuous solid polymer phase 5.

SPECIFIC EXAMPLE

The following example illustrates the application of the invention:

| | Parts by Weight |
|---|---|
| Polymer from Group I (Polystyrene 143E) | 15 |
| Polymer from Group II (Complementary Polymer ethylene-vinylacetate copolymer) | 25 |
| Ester wax (PE WB-14) | 35 |
| Color pigment-carbon black (Special-Russ 215 of | 25 |
| Degussa AG) | 25 |
| Solvent (toluene) | 30 |

The materials are transformed into an emulsion in a conventional stirrer. The emulsion is then milled for 10 minutes in a ball mill to improve the distribution of the color pigment. The resulting emulsion is applied by a doctor blade in a thickness of 9 micrometers to a polyester support foil of a thickness of 6 micrometers. Air heated to 80° C. is then passed over the coated foil to evaporate the solvent. The resulting solidified color-transfer layer was found to be useful for a minimum of five strikes utilizing a conventional thermal printing head on rough paper.

We claim:

1. A thermal-transfer ribbon, comprising:

a support strip; and a thermally transferable image-transfer layer on said support strip comprising a solid continuous phase in which a coloring agent is dispersed, a coloring-agent-containing discontinuous phase consisting of solid beads of a polymer meltable during the thermal-transfer process and distributed in said continuous phase, said solid continuous phase being formed by at least in part.

2. The thermal-transfer ribbon defined in claim 1 wherein said substance is an ester wax.

3. The thermal-transfer ribbon defined in claim 1 wherein the polymer of said beads is at least one polymer selected from the group consisting of polystyrenes, polyacrylates and polyamides.

4. The thermal-transfer ribbon defined in claim 1 wherein said polymer forming said solid continuous phase is at least one polymer selected from the group which consists of polyethylenevinylacetate, a polyvinylether and a polyvinylester.

5. A method of making a thermal-transfer ribbon which comprises the steps of:

forming a solution in a vaporizable solvent of two different mutually incompatible thermoplastic polymers which are meltable during a thermal transfer process to form a two-phase liquid/liquid phase-separation system in the solution;

adding to said two-phase liquid/liquid phase-separation system with stirring at least one coloring agent and a wax to form a color emulsion in said solvent;

coating said color emulsion onto a support strip; and evaporating said solvent from said color emulsion on said support strip to form a thermally transferrable image-transfer layer on said support strip comprising a solid continuous phase of one of said polymers in which said coloring agent is dispersed, and a pigment-containing discontinuous phase consisting of solid beads of the other of said polymers distributed in said continuous phase.

6. The method defined in claim 5 wherein said wax is an ester wax.

7. The method defined in claim 5 wherein said solvent is an aromatic hydrocarbon.

8. The method defined in claim 7 wherein said solvent is toluol.

9. The method defined in claim 7 wherein said one of said polymers is at least one polymer selected from the group which consists of polyethylenevinylacetate, a polyvinylether and a polyvinylester.

10. The method defined in claim 7 wherein said other of said polymers is at least one polymer selected from the group consisting of polystyrenes, polyacrylates and polyamides.

* * * * *